US010553377B2

(12) United States Patent
Binner et al.

(10) Patent No.: US 10,553,377 B2
(45) Date of Patent: Feb. 4, 2020

(54) ARRANGEMENT AND METHOD FOR GUIDING A SWITCH ROD OF A HIGH-VOLTAGE CIRCUIT BREAKER

(71) Applicant: SIEMENS AKTIENGESELLSCHAFT, Munich (DE)

(72) Inventors: Lukas Binner, Berlin (DE); Ingolf Reiher, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 16/074,273

(22) PCT Filed: Jan. 27, 2017

(86) PCT No.: PCT/EP2017/051774
§ 371 (c)(1),
(2) Date: Jul. 31, 2018

(87) PCT Pub. No.: WO2017/144233
PCT Pub. Date: Aug. 31, 2017

(65) Prior Publication Data

US 2019/0341208 A1 Nov. 7, 2019

(30) Foreign Application Priority Data

Feb. 25, 2016 (DE) ..... 10 2016 002 261

(51) Int. Cl.
*H01H 33/666* (2006.01)
*H01H 33/662* (2006.01)

(52) U.S. Cl.
CPC .... *H01H 33/66238* (2013.01); *H01H 33/666* (2013.01); *H01H 33/66207* (2013.01);
(Continued)

(58) Field of Classification Search
CPC ..... H01H 33/66238; H01H 33/666; H01H 33/66207; H01H 2033/66223; H01H 2033/66253; H01H 2033/66246
See application file for complete search history.

(56) References Cited

U.S. PATENT DOCUMENTS 3,026,394 A 3/1962 Jennings
3,941,960 A * 3/1976 Umeya ..... H01H 33/664 218/125

(Continued)

FOREIGN PATENT DOCUMENTS

CN 104576175 A 4/2015
DE 2440827 A1 3/1976

(Continued)

*Primary Examiner* — Truc T Nguyen
(74) *Attorney, Agent, or Firm* — Laurence Greenberg; Werner Stemer; Ralph Locher

(57) ABSTRACT

An arrangement for a high-voltage circuit breaker includes at least one movable electric contact piece of an interrupting unit. The at least one movable contact piece is disposed on a switch rod and the switch rod is movably mounted between an outer region and an inner region of the housing of the interrupting unit. The switch rod is guided in a solely linear manner in the arrangement. A method for driving the at least one movable electric contact piece includes using the switch rod to move the contact piece. The switch rod is moved in a solely linear manner along the longitudinal axis of the switch rod.

19 Claims, 3 Drawing Sheets

(52) U.S. Cl.
CPC ..... *H01H 2033/66223* (2013.01); *H01H 2033/66246* (2013.01); *H01H 2033/66253* (2013.01)

(56) References Cited

U.S. PATENT DOCUMENTS 5,004,877 A * 4/1991 Yin ..... H01H 33/66238 218/123
8,471,166 B1 * 6/2013 Glaser ..... H01H 33/666 218/124
8,497,446 B1 * 7/2013 Glaser ..... H01H 33/666 218/118
10,170,255 B1 * 1/2019 Glaser ..... H01H 33/666
2004/0164052 A1 * 8/2004 Stoving ..... H01H 33/66207 218/118
2005/0166748 A1 * 8/2005 Schramm ..... B60T 13/57 91/376 R
2009/0032500 A1 * 2/2009 Kobayashi ..... H01H 33/666 218/140
2012/0175347 A1 * 7/2012 Glaser ..... H01H 33/166 218/140
2013/0075368 A1 * 3/2013 Marchand ..... H01H 33/662 218/140
2014/0224771 A1 * 8/2014 Rhein ..... H01H 33/666 218/140
2015/0303010 A1 * 10/2015 Yu ..... H01H 33/6644 218/140
2016/0126037 A1 * 5/2016 Gerovac ..... H01H 33/6606 218/139
2016/0254110 A1 * 9/2016 Bartz ..... H01H 1/50 218/124
2016/0284485 A1 * 9/2016 Berardengo ..... H01H 33/66207
2017/0250040 A1 * 8/2017 Sato ..... H01H 33/664
2017/0256374 A1 * 9/2017 Phillpotts ..... H01H 33/662

FOREIGN PATENT DOCUMENTS

DE 2440829 A1 3/1976
DE 19721611 A1 11/1998
DE 29824462 U1 4/2001
DE 102008018531 B3 9/2009

* cited by examiner (Stand der Technik)

ARRANGEMENT AND METHOD FOR GUIDING A SWITCH ROD OF A HIGH-VOLTAGE CIRCUIT BREAKER

BACKGROUND OF THE INVENTION

Field of the Invention

The invention relates to an arrangement for a high-voltage circuit breaker having at least one movable electrical contact piece of an interrupter unit, wherein the at least one movable contact piece is arranged on a switch rod, and a method for driving the at least one movable electrical contact piece, wherein the contact piece is moved via the switch rod.

High-voltage circuit breakers are used for switching high voltages and currents, in particular in the region of up to several 10,000 V and of up to several 1,000 A. To this end, an interrupter unit comprises electrical contacts, e.g. a nominal current contact and/or an arcing contact, each having two contact pieces, or only one contact having two nominal current contact pieces. A first contact piece of the respective contact can be arranged in a spatially fixed manner in the circuit breaker and a second contact piece of the same contact can be arranged in a movable manner in the circuit breaker. Both contact pieces can also be movably arranged for electrically closing and opening the circuit. The relative movement of the two contact pieces of a contact towards or away from one another is fundamental to the switching procedure, i.e. the electrical disconnection or connection of the contact.

High-voltage circuit breakers can contain a switching gas, e.g. $SF_6$, or be constructed in the manner of a vacuum tube. The interrupter unit is surrounded by a housing and the housing is closed or sealed in a gas-tight manner with respect to the environment. The gas-tight housing is filled with switching gas or evacuated to generate a vacuum in the housing. Owing to the effect of the switching gas or vacuum, the burning of an arc between the contact pieces during switching is inhibited and/or extinguished.

The movable contact piece(s) are mechanically connected to a gear and/or a drive, for example, via a kinematic chain. A drive can be designed for example in the form of a motor or a spring accumulator, and can provide mechanical energy during switching for the movement of electrical contact pieces. In this case, a switch rod as part of the kinematic chain can be used for transmitting the movement energy into the housing, to the movable contact pieces. The switch rod is connected to the movable contact pieces in the housing, directly and/or via lever elements, gear parts and/or other deflection devices, for example.

The sealing of the inner area of the housing in the region of the switch rod, e.g. by means of rotary transmission leadthroughs, and the manner of the force deflection, e.g. via lever and gear parts, from the drive to the switch rod, generally results in particular in a slight pendulum movement of the switch rod. In circuit breakers having a vacuum interrupter unit, i.e. in the manner of a vacuum tube, pendulum movements must be prevented. Bellows seals which are used are not stable in the long term under a torsional load, i.e. they can become damaged or destroyed by pendulum movements. A bellows contained in a vacuum tube requires the control of the switch rod to be as precise and linear as possible.

SUMMARY OF THE INVENTION

The object of the present invention is to prevent or reduce the problems described above. In particular, the object is to provide an arrangement for a high-voltage circuit breaker which has fewer components or elements than conventional arrangements for driving movable contact pieces of the interrupter unit of the high-voltage circuit breaker, results in lower costs, and has a greater reliability and durability. In particular in vacuum tubes, the object is to transmit the movement energy from the outer region into the inner region of the vacuum tube via a switch rod, whilst ensuring that the seal-tightness of the vacuum tube, in particular sealed via a bellows, is stable in the long term without the bellows becoming damaged or destroyed over time as a result of pendulum movements of the switch rod. The object is furthermore to provide at least one movable electrical contact piece of a high-voltage circuit breaker which prevents the problems described above analogously to the arrangement.

The object presented is achieved according to the invention by an arrangement for a high-voltage circuit breaker and/or by a method for driving at least one movable electrical contact piece of a high-voltage circuit breaker, in particular using the arrangement described above. Advantageous embodiments of the arrangement according to the invention and/or the method according to the invention are presented in the sub claims. In this case, subject-matters of the main claims may be combined with one another and with features of sub claims, and features of the sub claims may be combined with one another.

An arrangement according to the invention for a high-voltage circuit breaker comprises at least one movable electrical contact piece of an interrupter unit, wherein the at least one movable contact piece is arranged on a switch rod. The switch rod is movably mounted between the outer region and the inner region of the housing of the interrupter unit, with an exclusively linear control of the switch rod.

The bearing of the switch rod, with an exclusively linear control, prevents or eliminates pendulum movements of the switch rod. In particular in vacuum tubes, e.g. with bellows, seal-tightness which is stable in the long term without the bellows being damaged or destroyed over time is ensured by eliminating pendulum movement of the switch rods. Movement energy is transmitted from the outer region into the inner region of the high-voltage circuit breaker via the switch rod without using rotary transmission leadthroughs. Rotary transmission leadthroughs generally have a plurality of parts or elements and are difficult to seal in a gas-tight manner, in particular in the case of high pressure differences of several bar between the outer region and inner region. By dispensing with rotary transmission leadthroughs and through the use of a linear control, in particular in conjunction with a bellows, good seal-tightness is achieved with reduced costs and fewer components as well as good durability of the arrangement.

The linear control of the switch rod can comprise an anti-twist mechanism. This can be formed by a movable body, for example, which is linearly movably arranged in a groove. A linear or straight groove results in a linear movement of the body in the groove and, owing to the rigid connection of the body to the switch rod, a rotation of the switch rod about its longitudinal axis is prevented. It is also possible to use two bodies which are opposite one another on the switch rod and arranged on opposing sides of the switch rod, which bodies are movably arranged in two mutually opposing grooves. It is alternatively possible to use more than two body/groove pairs and/or to arrange a plurality of bodies in one groove, which bodies are in particular rigidly connected to the switch rod.

The movable body/bodies can have a cylindrical form, in particular a screw form. The screws can be screwed in a threaded hole in the switch rod. Instead of screws, it is, for example, alternatively possible to use other elements, for example bolts, as bodies. The bodies can also be formed from the material of the switch rod, in particular in one piece from the switch rod, for example by forming the switch rod with indentations. The switch rod can also be designed to be rectangular instead of round and run in the groove in the same manner as in a rail. To this end, the switch rod can have a greater diameter in the region of the groove than in other regions along its longitudinal axis.

The interrupter unit can be a vacuum interrupter unit in a vacuum tube, in particular having at least one nominal current contact having two nominal current contact pieces in each case and having at least one arcing contact having two arcing contact pieces in each case. It is also alternatively possible for only nominal current contact pieces to be used.

Unlike the rotary transmission leadthrough, the base area of the switch rod is located outside a gas compartment of the high-voltage circuit breaker. Therefore, in vacuum interrupter units, for example, only a pressure force which is produced by the pressure difference between the vacuum interrupter unit and an atmospheric pressure, for example in the region of 1 bar, is in effect and not a pressure force which is defined by the pressure difference between a vacuum interrupter unit and the gas or pressure compartment, e.g. in the region of 3 to 6 bar. The drive energy which is necessary for example for opening the circuit is thus reduced considerably. A more economical drive having smaller dimensions can be used.

The linear control of the switch rod can be arranged in a supporting foot of the high-voltage circuit breaker and/or in the region of a switch rod foot. Owing to the construction described, a smaller installation space is required and costs and material are reduced. The sealing function can be integrated in the supporting foot and a linear control in the supporting foot results in improved sealing which is stable in the long term since a pendulum movement in the region of the seal in the supporting foot is prevented.

At least one slide bearing can be arranged in the region of the linear control of the switch rod. The slide bearing reduces friction losses and enables a movement of the switch rod with less force than without a slide bearing.

The inner region of the housing of the interrupter unit can be sealed in a gas-tight manner with respect to the outer region via the switch rod and a sealing element arranged between the switch rod and the housing, in particular with a bellows as the sealing element. Bellows enable sealing in the case of high pressure differences for movable parts, are durable in the case of a linear control of the switch rod without pendulum movements, are economical and are simple to construct.

The sealing element, in particular the bellows, can be arranged in the region of the switch rod foot, in particular connected and/or fastened in a mechanically fixed manner to the switch rod foot in a gas-tight manner via a concentrically arranged radial seal. This results in a compact construction with the advantages described above.

The switch rod foot of the switch rod can be arranged concentrically in the supporting foot of the housing and/or with respect to the slide bearing, in particular with an exclusively linearly movable switch rod along the longitudinal axis of the switch rod. This likewise results in a compact high-voltage circuit breaker with the advantages described above, in particular with the construction described above.

A sliding sleeve can spatially comprise the switch rod, in particular with one part rigidly mechanically connected to the switch rod in the region of the switch rod foot, in particular formed for a linear movement in the direction of the longitudinal axis of the switch rod in a cylindrical cutout in the supporting foot of the high-voltage circuit breaker. The sliding sleeve reduces the friction between the switch rod and the supporting foot and therefore reduces the effort for moving the switch rod and switching the high-voltage circuit breaker. The drive can therefore be designed with smaller dimensions and more economically.

A bellows for the gas-tight sealing of the inner region of the housing of the interrupter unit with respect to the outer region can be arranged between the switch rod foot and the cylindrical cutout of the supporting foot of the high-voltage circuit breaker, in particular fastened in a gas-tight manner to the cylindrical cutout of the supporting foot on a side towards the interrupter unit and/or fastened in a gas-tight manner to the switch rod foot on the opposing side, in particular on the side with the cylindrical body. An inverse construction is likewise possible, with a bellows fastened in particular in a gas-tight manner to the cylindrical cutout of the supporting foot on a side facing away from the interrupter unit and/or fastened in a gas-tight manner to the switch-rod foot on the side towards the interrupter unit. This is associated with a change of the side of the bellows having gas pressure acting on the bellows according to the inner and outer area of the housing. With a cylindrical bellows, in the first exemplary embodiment, gas pressure corresponding to the gas pressure in the outer region of the housing prevails on the outside of the bellows and a gas pressure corresponding to the gas pressure in the inner region of the housing prevails on the inside of the bellows. In the latter exemplary embodiment, gas pressure corresponding to the gas pressure in the outer region of the housing prevails on the bellows on the inside of the bellows and a gas pressure corresponding to the gas pressure in the inner region of the housing prevails on the outside of the bellows. The respective advantages of the two exemplary embodiments are produced according to mechanical and structural requirements.

A coupling element can be provided on the switch rod for coupling to the kinematic chain of the high-voltage circuit breaker and/or a gear and/or a drive, in particular at one end of the switch rod in the region of the switch rod foot. The drive or further elements of the kinematic chain are mechanically coupled to the switch rod via the coupling element in a mechanically simple and economical manner for transmitting the movement to the switch rod.

A method according to the invention for driving at least one movable electrical contact piece of a high-voltage circuit breaker, in particular having an arrangement described above, comprises that the at least one movable contact piece is moved via a switch rod and the switch rod is moved exclusively linearly along the longitudinal axis of the switch rod.

A sealing element, in particular a bellows, can seal the evacuated inner region of the housing in a gas-tight manner between the switch rod and the housing of the high-voltage circuit breaker.

The switch rod can be movably mounted between the outer region and the inner region of the housing, in particular in the region of the supporting foot, with a linear control of the switch rod, in particular via cylindrical bodies on the switch rod guided in guide grooves in the supporting foot which prevent a twisting of the switch rod, in particular in the form of a rotation about the longitudinal axis of the switch rod.

The advantages of the method according to the invention for driving at least one movable electrical contact piece of a high-voltage circuit breaker are analogous to the above-described advantages of the arrangement for a high-voltage circuit breaker.

Hereinafter, an arrangement having a rotary transmission lead through according to the prior art is illustrated schematically in FIG. 1 and described in more detail below, and an exemplary embodiment of the invention without a rotary transmission lead through, having a linear lead through, is illustrated schematically in FIGS. 2 and 3 and described in more detail below.

DESCRIPTION OF THE INVENTION

Figure 1:
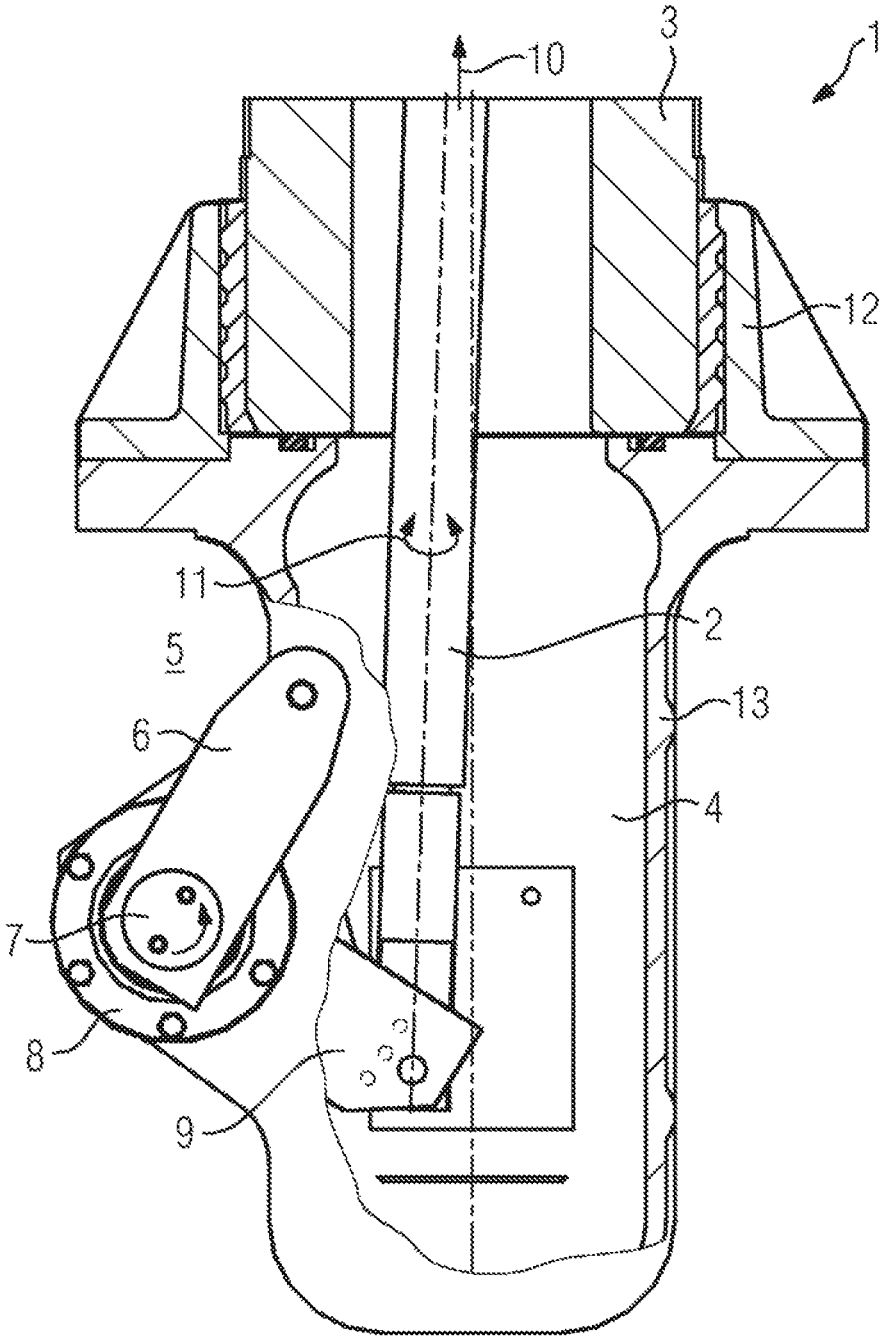
FIG. 1 a schematic sectional illustration of an arrangement 1 for a high-voltage circuit breaker having a rotary transmission leadthrough through a housing 3 for driving a switch rod 2 according to the prior art.

FIG. 1 shows a schematic sectional illustration of an arrangement 1 for a high-voltage circuit breaker according to the prior art for driving a movable electrical contact piece via a switch rod 2, having a rotary transmission lead through through the housing 3 of the high-voltage circuit breaker or an interrupter unit 15. The rotary transmission lead through comprises a rotary shaft 7 for transmitting a rotational movement from the outer region 5 into the inner region 4 of the housing 3 of the high-voltage circuit breaker and a rotary shaft having a packing seal 8 for the gas-tight sealing of the inner region 4 with respect to the outer region 5.

A drive, for example a spring accumulator drive or an electric motor, provides movement energy for switching the high-voltage circuit breaker. The drive is not illustrated in the figures for the sake of simplicity. The movement energy is transmitted to one or more movable contact pieces via a kinematic chain in order to open or close the contacts of the interrupter unit. The high-voltage circuit breaker is thereby switched. The contact(s) with contact pieces are not illustrated in FIG. 1 for the sake of simplicity. For example, it is possible to include a nominal current contact with a movable contact piece and a fixed contact piece as an interrupter unit, or two movable contact pieces as a nominal current contact of the high-voltage circuit breaker. Alternatively, instead of only a nominal current contact, it is possible for the interrupter unit to comprise a nominal current contact and an arcing contact. Each contact can comprise a movable and a fixed contact piece, for example, or each can comprise two movable contact pieces.

The movable contact piece(s) are mechanically connected to a switch rod 2 directly, in particular for a linear force effect, or indirectly, for example via a coupling gear, in particular for a force deflection. The switch rod 2 and the contact pieces of the contacts of the interrupter unit 15 are arranged in a housing 3. In the inner region 4, the housing is filled with a switching gas, e.g. $SF_6$, in particular at a higher pressure than in the outer region 5. When using a vacuum interrupter unit in a vacuum tube, the region of the vacuum interrupter unit is evacuated.

The switch rod 2, as part of the kinematic chain, is mechanically connected to a movable inner lever 9, which is mechanically connected to a movable outer lever 6 via the rotary shaft 7. The outer lever 6 is connected to the drive via a rod and/or a gear, for example. Analogously to the drive, the rod and the gear are not illustrated in the figures for the sake of simplicity. The movement energy during switching is transmitted from the drive to the movable contact piece(s) via the kinematic chain, in particular via the outer lever 6, the rotary shaft 7, the inner lever 9 and the switch rod 2. When closing the circuit, a movement by the switch rod is transmitted in direction 10; when opening the circuit, it is transmitted in the opposite direction. Thus, when closing the circuit, the contact pieces of a contact are moved towards one another and the electrical contact is closed. When opening the circuit, the contact pieces of a contact are moved away from one another and the electrical contact is opened.

The movement transmitted by the rotary shaft 7 via the inner lever 9 to the switch rod 2, which converts a rotational movement into a longitudinal movement, generates a pendulum movement 11 of the switch rod 2, with a component in the perpendicular direction to the longitudinal axis of the switch rod 2. The longer the switch rod 2 in relation to the length of the inner lever 9, the smaller the component of the pendulum movement 11 with respect to the switching movement in direction 10 parallel to the center axis of the interrupter unit 15 of the housing 3.

The housing 3 comprises a supporting foot 12, via which the housing 3 is fastened, for example, to a frame for positioning the high-voltage circuit breaker. A plurality of housings 3 of interrupter units and the drive and/or elements of the kinematic chain can be fastened to the frame. The interrupter unit 15 is arranged for example in a substantially cylindrical isolator housing, which is fastened in the lower region to the supporting foot 12 and held by this latter. A housing lower part 13, for example made from a cast iron material, closes the housing 3 in the lower region in a gas-tight manner. The rotary transmission leadthrough with the rotary shaft 7 and the rotary bearing with the packing seal 8 is arranged in the housing lower part 13 and connected to the switch rod 2 via the inner lever 9 in the region of the switch rod foot or at the lower end of the switch rod 2.

The switch rod 2 with the contact(s) is therefore arranged completely in the inner region 4 of the gas-tight housing 3 and a pendulum movement 11 of the switch rod 2 has no influence on the gas-tightness of the interrupter unit or the housing 3 of the interrupter unit. The sealing effect is determined by the packing seal of the rotary bearing 8. A construction for high pressure differences of the inner region 4 with respect to the outer region 5 can be expensive and complex, or impossible from a certain pressure difference. Owing to the rotary transmission leadthrough, a large number of parts or elements are required in the kinematic chain, for example levers 6, 9 and shafts 7 with rotary bearing 8 and packing seal. This makes the construction complicated, expensive and material-intensive as well as heavy. The switch rod has to have a long length to minimize the influence of the pendulum movement 11 on the switching and the contact pieces. With frequent switching, the pendulum movement 11 can result in damage to the contact pieces, and only contact pieces with a special design can be used, in particular with a small contact area in relation to the contact piece length, or rounded contact pieces.

Figure 2:
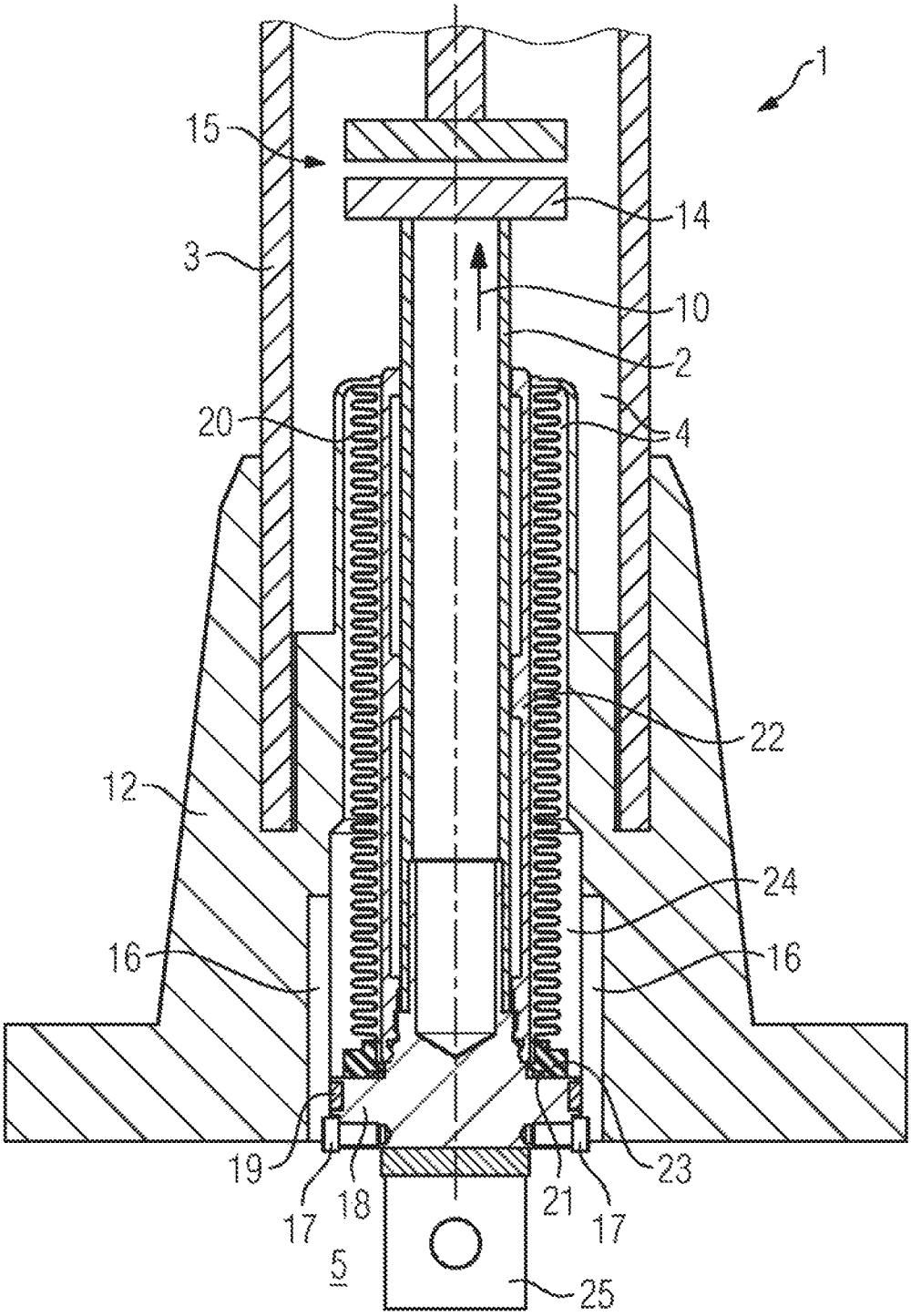
FIG. 2 a schematic sectional illustration of an arrangement 1 according to the invention for a high-voltage circuit breaker having a switch rod 2 which is movably mounted between the outer region 5 and the inner region 4 of the housing 3, with an exclusively linear control.

To prevent the above-described disadvantages of the arrangement according to the prior art, in particular according to FIG. 1, an arrangement according to the invention comprises an exclusively linear control of the switch rod and prevents a pendulum movement of the switch rod 2. In FIG. 2, an arrangement 1 according to the invention is illustrated schematically in a sectional illustration, with a switch rod 2 which is movably mounted between the outer region 5 and the inner region 4 of the housing 3 and is guided exclusively linearly or executes an exclusively linear movement without a pendulum movement.

An interrupter unit 15, in particular a vacuum interrupter unit, which comprises two contact pieces, is arranged in a housing 3. In the exemplary embodiment illustrated in FIG. 2, one contact piece is arranged in a fixed manner and one contact piece 14 is arranged in a movable manner; alternatively, both contact pieces can also be arranged in a movable manner. In addition to the nominal current contact pieces illustrated, nominal and arcing contact pieces can be included, which is not illustrated in the figures for the sake of simplicity.

The movable contact piece 14 is fastened to the switch rod 2, in particular at one end of the switch rod 2, in the housing 3. With a movement for closing the circuit, the switch rod 2 is moved in direction 10, exclusively parallel to the longitudinal axis of the switch rod 2. With a movement for opening the circuit, the movable contact piece 14 is moved with the switch rod 2 in the opposite direction to direction 10.

A coupling element 25 is arranged on the opposing side of the switch rod 2, opposite the side with the movable contact piece 14, on the end of the switch rod 2 outside the housing 3. The switch rod 2 is connected to further elements of the kinematic chain and the drive via the coupling element 25, which is not illustrated in the figures for the sake of simplicity. Via the coupling element 25, a movement which is provided by the drive is transmitted to the switch rod 2 in the direction 10 or in the opposite direction.

In addition to an electrical isolator, in particular a substantially tubular isolator with ribs on the outside, for example, the housing 3 comprises a supporting foot 12, which is arranged at the lower end of the isolator and via which the, for example, tubular isolator is positioned vertically. The isolator is made for example from ceramic, a silicone material or a composite material. The supporting foot 12 is made for example from a metal, in particular cast iron or steel. The isolator is for example bonded or cast into the supporting foot 12 in a gas-tight manner. A continuous cutout 24 in the shape of a hollow tube or sleeve is formed in the supporting foot 12, in particular center-symmetrically about the center axis 26 of the supporting foot 12. The switch rod 2 is guided through the cutout 24, from the outer region 5 into the inner region 4 of the housing 3. The switch rod 2 is encompassed by a sliding sleeve 22 and enclosed in a gas-tight manner. The sliding sleeve 22 is designed in such a way that it moves in the cutout 24 of the supporting foot 12, along the longitudinal axis 26 of the switch rod 2 or the congruent center axis 26 of the supporting foot 12, upon a movement of the switch rod 2.

A sealing element, in a particular a bellows 20, is arranged or mounted between the switch rod 2, or the sliding sleeve 22, and the cutout 24 in the supporting foot 12. The bellows 22, in conjunction with the switch rod 2, seals the cutout of the supporting foot 12 in a gas-tight manner and therefore delimits the inner region 4 of the housing 3 with respect to the outer region 5. The inner region 4 can be filled with a switching gas, e.g. $SF_6$, or be at vacuum level, for example, i.e. evacuated. Fittings are also possible, with which the housing 2 is filled with an insulating gas, and/or an evacuated vacuum tube with the contact pieces of the interrupter unit 15 is arranged in the housing 2. As illustrated in FIG. 2, the bellows 20 can be fixedly connected to the switch rod 2 in a gas-tight manner at the switch rod foot 18 of the switch rod 2, i.e. at the lower end of the switch rod 2, in particular via a sealing flange 23. On the opposite side of a substantially cylindrical bellows 20, the bellows 20 can be fixedly connected to the cutout of the supporting foot 12 in a gas-tight manner, in particular at the end of the cutout towards the contact pieces.

In the region of the switch rod foot 18, the switch rod 2 can be designed analogously to a piston and can move in the, in particular, substantially cylindrical cutout of the supporting foot 12, sealed by a radial seal 21 between the cutout 24 and the switch rod foot 18. Bodies 17 can be arranged in the switch rod foot 18, for example in the form of screws screwed into the switch rod foot 18 on opposite sides of a circumferential line of the switch rod foot 18, wherein the screw heads project radially out of the switch rod. These bodies 17 move with the switch rod 2 and can move in, in particular, linear grooves 16 or depressions in the cutout 24 of the supporting foot 12 or in the supporting foot 12 analogously to tram wheels in tram tracks. An anti-twist mechanism of the switch rod 2 is thus produced, i.e., as a result of the control, the switch rod is unable to rotate about its axis 26. At least one slide bearing 19 is arranged in the region of the linear control or guidance of the switch rod 2.

A linear control of the switch rod 2 is produced as a result of the cylindrical sliding sleeve 22 and/or the cylindrical switch rod 2, which is movable in a cylindrical cutout in the supporting foot 12, in particular mounted towards the contact pieces on one side, and/or the linear control comprising the bodies 17 in the linear grooves 16, in particular arranged on the side remote from the contact pieces. The movement of the switch rod 2 takes place exclusively in direction 10 or in the opposite direction along the longitudinal axis 26 of the switch rod 2, without a pendulum movement. The anti-twist mechanism prevents twisting of the switch rod 2 during the movement. The seal in the form of a bellows 20 is thus only loaded in the longitudinal direction of the bellows 20, which ensures good gas-tight sealing of the inner region 4 with respect to the outer region 5 of the housing 3 which is stable in the long term.

Figure 3:
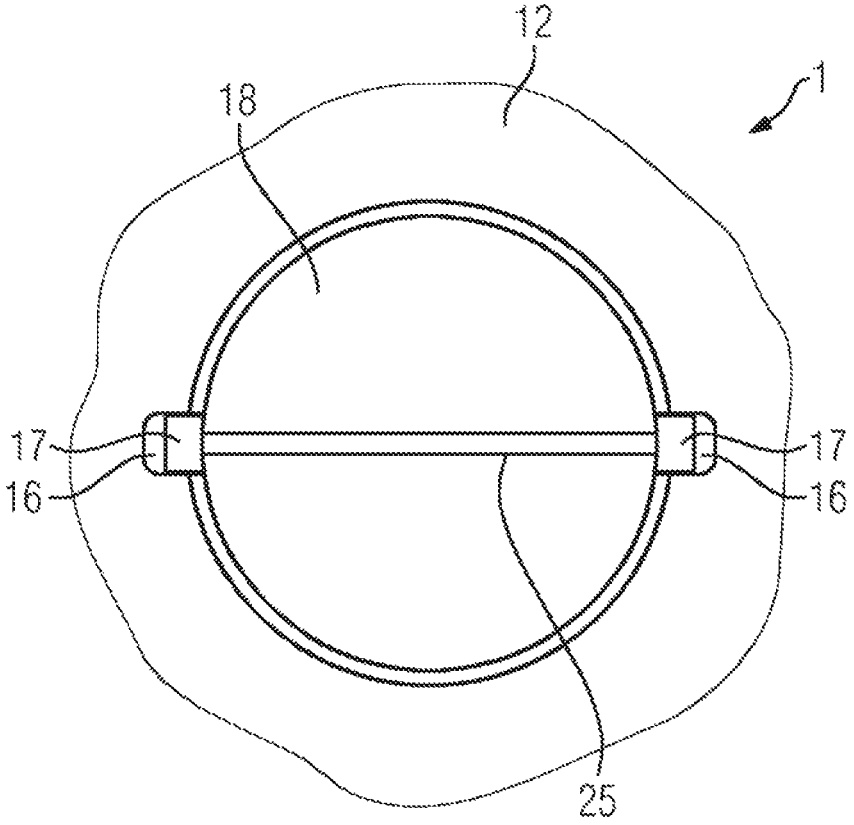
FIG. 3 a schematic detail of a plan view from the underside of the arrangement 1 illustrated in FIG. 2.

A detail of a plan view of the underside of the arrangement 1 illustrated in FIG. 2 is illustrated schematically in FIG. 3. The coupling element 25 at the lower end of the switch rod 2, for coupling elements of the kinematic chain towards the drive, is arranged on the base area of the cylindrical switch rod 2 or the cylindrical switch rod foot 18. The substantially cylindrical switch rod foot 18, designed analogously to a piston in an internal combustion engine, is arranged with mechanical fit in the cylindrical cutout in the supporting foot 12, and an anti-twist mechanism, comprising the bodies 17 movably arranged in the grooves 16, prevents a rotational movement of the switch rod 2 about its longitudinal axis 26. During the switching of the high-voltage circuit breaker, the switch rod 2 executes an exclusively linear movement perpendicularly to the plane of the drawing in FIG. 3; into the plane of the drawing for closing the circuit and out of the plane of the drawing for opening the circuit. Pendulum movements of the switch rod 2, with movement components in a direction parallel to the plane of the drawing, are suppressed or impossible as a result of the linear control or bearing of the switch rod 2 in the cutout 24 of the supporting foot 12.

The exemplary embodiments described above can be combined with one another and/or can be combined with the prior art.

LIST OF REFERENCE SIGNS

1 Arrangement for a high-voltage circuit breaker
2 Switch rod
3 Housing
4 Inner region
5 Outer region
6 Outer lever
7 Rotary shaft
8 Rotary bearing with packing seal
9 Inner lever
10 Movement direction along the longitudinal direction of the switch rod
11 Pendulum movement of the switch rod
12 Supporting foot
13 Housing lower part with lead through for elements of the kinematic chain
14 Movable contact piece
15 Interrupter unit
16 Groove
17 Body
18 Switch rod foot
19 Slide bearing
20 Bellows
21 Radial seal
22 Sliding sleeve
23 Sealing flange of the bellows
24 Cylindrical cutout
25 Coupling element
26 Longitudinal axis of the switch rod

The invention claimed is:

1. An anti-twist assembly for a high-voltage circuit breaker, the anti-twist assembly comprising:

an interrupter unit including at least one movable electric contact piece, said interrupter unit having a housing supported by a supporting foot;

a switch rod being movably mounted with an exclusively linear guidance of said switch rod, said at least one movable contact piece being disposed on said switch rod; and an anti-twist mechanism including a switch rod foot connected to said switch rod and providing said linear guidance of said switch rod, said anti-twist mechanism including a body connected to said switch rod foot and being movable in a groove formed in said supporting foot.

2. The anti-twist assembly according to claim 1, wherein said movable body has a cylindrical shape.

3. The anti-twist assembly according to claim 2, wherein said movable body is a screw.

4. The anti-twist assembly according to claim 1, wherein said interrupter unit is a vacuum interrupter unit in a vacuum tube.

5. The anti-twist assembly according to claim 4, wherein said vacuum interrupter unit includes at least one nominal current contact having two nominal current contact pieces and at least one arcing contact having two arcing contact pieces.

6. The anti-twist assembly according to claim 1, which further comprises at least one slide bearing disposed in a region of said linear guidance of said switch rod.

7. The anti-twist assembly according to claim 1, which further comprises a sealing element disposed between said switch rod and said housing, an inner region of said housing being gas-tightly sealed relative to an outer region of said housing by said switch rod and said sealing element.

8. The anti-twist assembly according to claim 7, wherein said sealing element is a bellows.

9. The anti-twist assembly according to claim 8, wherein said switch rod said bellows is disposed in a region of said switch rod foot.

10. The anti-twist assembly according to claim 9, which further comprises a concentrically disposed radial seal at least one of connecting or fastening and gas-tightly mechanically fixing said bellows to said switch rod foot.

11. The anti-twist assembly according to claim 6, wherein said switch rod foot is disposed at least one of concentrically in said supporting foot of said housing or concentrically relative to said slide bearing, and said switch rod is exclusively linearly movable along a longitudinal axis of said switch rod.

12. The anti-twist assembly according to claim 1, which further comprises a sliding sleeve spatially surrounding said switch rod, said sliding sleeve having a part rigidly mechanically connected to said switch rod in a region of said switch rod foot, for permitting a linear movement in a direction of a longitudinal axis of said switch rod in a cylindrical cutout formed in said supporting foot.

13. The anti-twist assembly according to claim 12, which further comprises a bellows disposed between said switch rod foot and said cylindrical cutout of said supporting foot for gas-tightly sealing an inner region of said housing relative to an outer region of said housing.

14. The anti-twist assembly according to claim 13, wherein said bellows is at least one of:

gas-tightly fastened to said cylindrical cutout of said supporting foot on a side facing towards said interrupter unit, or gas-tightly fastened to said switch rod foot on a side facing away from said interrupter unit.

15. The anti-twist assembly according to claim 14, wherein said groove is formed on said side facing away from said interrupter unit.

16. The anti-twist assembly according to claim 1, which further comprises a coupling element disposed on one end of said switch rod in a region of said switch rod foot for coupling to at least one of a kinematic chain of the high-voltage circuit breaker or a gear or a drive.

17. A method for driving at least one movable electrical contact piece of a high-voltage circuit breaker, the method comprising the following steps:

providing an interrupter unit having at least one movable contact piece and having a housing supported by a supporting foot;

providing a switch rod having a longitudinal axis and being movably mounted with an exclusively linear guidance of the switch rod, the at least one movable contact piece being disposed on the switch rod;

providing an anti-twist mechanism including a switch rod foot connected to the switch rod and providing the linear guidance of the switch rod, the anti-twist mechanism including a body connected to the switch rod foot and being movable in a groove formed in the supporting foot; and using the switch rod to move the at least one movable contact piece exclusively linearly along the longitudinal axis of the switch rod.

18. The method according to claim 17, which further comprises using a sealing element or a bellows to gas-tightly seal an evacuated inner region of the housing between the switch rod and the housing.

19. The method according to claim 17, which further comprises using the body to linearly guide the switch rod between an outer region and an inner region of the housing while preventing a twisting or rotation of the switch rod about the longitudinal axis of the switch rod.

* * * * *